US009588459B2

(12) United States Patent
Uno et al.

(10) Patent No.: US 9,588,459 B2
(45) Date of Patent: Mar. 7, 2017

(54) DEVELOPING DEVICE HAVING DEVELOPING ROLLER AND THICKNESS-REGULATING BLADE

(71) Applicant: Brother Kogyo Kabushiki Kaisha, Nagoya-shi, Aichi (JP)

(72) Inventors: Takanori Uno, Nisshin (JP); Takuya Amaike, Nagoya (JP); Kenta Tosuji, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/060,047

(22) Filed: Mar. 3, 2016

(65) Prior Publication Data

US 2016/0259266 A1 Sep. 8, 2016

(30) Foreign Application Priority Data

Mar. 4, 2015 (JP) ..... 2015-042322

(51) Int. Cl.
*G03G 15/08* (2006.01)

(52) U.S. Cl.
CPC ..... *G03G 15/0812* (2013.01)

(58) Field of Classification Search
USPC ..... 399/91, 98, 103, 119, 120, 284
See application file for complete search history.

(56) References Cited

U.S. PATENT DOCUMENTS 5,946,530 A * 8/1999 Tsuji ..... G03G 15/0817 399/103
6,321,050 B1 * 11/2001 Sato ..... G03G 15/0898 399/103
2012/0057897 A1 * 3/2012 Itabashi ..... G03G 15/0898 399/103
2014/0178093 A1 * 6/2014 Nishiwaki ..... G03G 15/0817 399/103
2014/0376954 A1 * 12/2014 Uno ..... G03G 15/0898 399/103

FOREIGN PATENT DOCUMENTS

JP 2010-164736 A 7/2010

* cited by examiner

*Primary Examiner* — Hoan Tran
(74) *Attorney, Agent, or Firm* — Banner & Witcoff, Ltd.

(57) ABSTRACT

In a developing device, a developing roller has a circumferential surface and an axial end portion. A thickness-regulating blade includes a pressing part protruding to contact the circumferential surface. A first sealing member is provided between a housing and the axial end portion, and includes a first layer; and a second layer. The first layer has a first layer surface disposed to contact the circumferential surface. The second layer supports the first layer and has a protruding part protruding inward of the first layer in an axial direction of the developing roller and having a second layer surface opposing the circumferential surface. The housing has a wall part disposed between the pressing part and the protruding part in the rotating direction of the developing roller. The wall part has an opposing surface opposing the circumferential surface. A lubricant is applied to the first layer surface and the second layer surface.

18 Claims, 6 Drawing Sheets

DEVELOPING DEVICE HAVING DEVELOPING ROLLER AND THICKNESS-REGULATING BLADE

CROSS REFERENCE TO RELATED APPLICATION

This application claims priority from Japanese Patent Application No. 2015-042322 filed Mar. 4, 2015. The entire content of the priority application is incorporated herein by reference.

TECHNICAL FIELD

The present disclosure relates to a developing device provided with sealing members that contact two axial ends of a developing roller.

BACKGROUND

A developing device known in the art (see Japanese Patent Application Publication No. 2010-164736, for example) is provided with a housing, a developing roller rotatably supported in the housing, a thickness-regulating blade having a rubber blade part that contacts the circumferential surface of the developing roller, and sealing members disposed between the housing and the two axial ends of the developing roller. In particular, the sealing members are shaped to conform to the circumferential surface of the developing roller. One end of each sealing member in the rotating direction of the developing roller is in contact with the corresponding end face of the rubber blade part in the axial direction thereof.

SUMMARY

The thickness-regulating blade in the conventional developing device described above is further provided with a pressing member for scraping developer from the circumferential surface of the developing roller. As the pressing member scrapes developer from the developing roller, the developer flows rapidly outward along the pressing member in axial directions of the developing roller and can leak out of the device through gaps between the sealing members and developing roller.

In view of the foregoing, it is an object of the present disclosure to provide a developing device capable of restraining developer from leaking out of the device.

In order to attain the above and other objects, the one aspect provides a developing device that includes: a housing; a developing roller; a thickness-regulating blade; a first sealing member; and a lubricant. The developing roller is rotatable in a rotation direction. The developing roller extends in an axial direction and has a circumferential surface and an axial end portion. The thickness-regulating blade includes a blade; and a pressing part. The blade has a distal end portion. The pressing part is elongated in the axial direction and protrudes from the distal end portion to contact the circumferential surface of the developing roller. The first sealing member is provided between the housing and the axial end portion. The first sealing member includes a first layer; and a second layer. The first layer has a first layer surface. The first layer surface is disposed to contact the circumferential surface of the developing roller. The second layer supports the first layer. The second layer has a protruding part. The protruding part protrudes inward of the first layer in the axial direction. The protruding part has a second layer surface. The second layer surface opposes the circumferential surface of the developing roller. The housing has a wall part. The wall part is disposed between the pressing part and the protruding part in the rotating direction. The wall part has an opposing surface. The opposing surface opposes the circumferential surface of the developing roller. The lubricant is applied to the first layer surface and the second layer surface.

BRIEF DESCRIPTION OF THE DRAWINGS

The particular features and advantages of the disclosure as well as other objects will become apparent from the following description taken in connection with the accompanying drawings, in which:

FIG. 3A illustrates a state in which a side seal and a side edge seal are removed and FIG. 3B illustrates a state in which the side edge seal and a base layer are fixed;

FIG. 4A illustrates a cross-sectional view of the developing device taken along a plane I-I shown in FIG. 2 and FIG. 4B illustrates a cross-sectional view of the developing device taken along a plane shown in FIG. 4A;

FIG. 6A is a perspective view simply illustrating the surface layer and FIG. 6B is an enlarged view of a surface of the surface layer that confronts a developing roller.

DETAILED DESCRIPTION

A developing device according to an embodiment of the present disclosure will be described in detail below while referring to the accompanying drawings.

Figure 1:
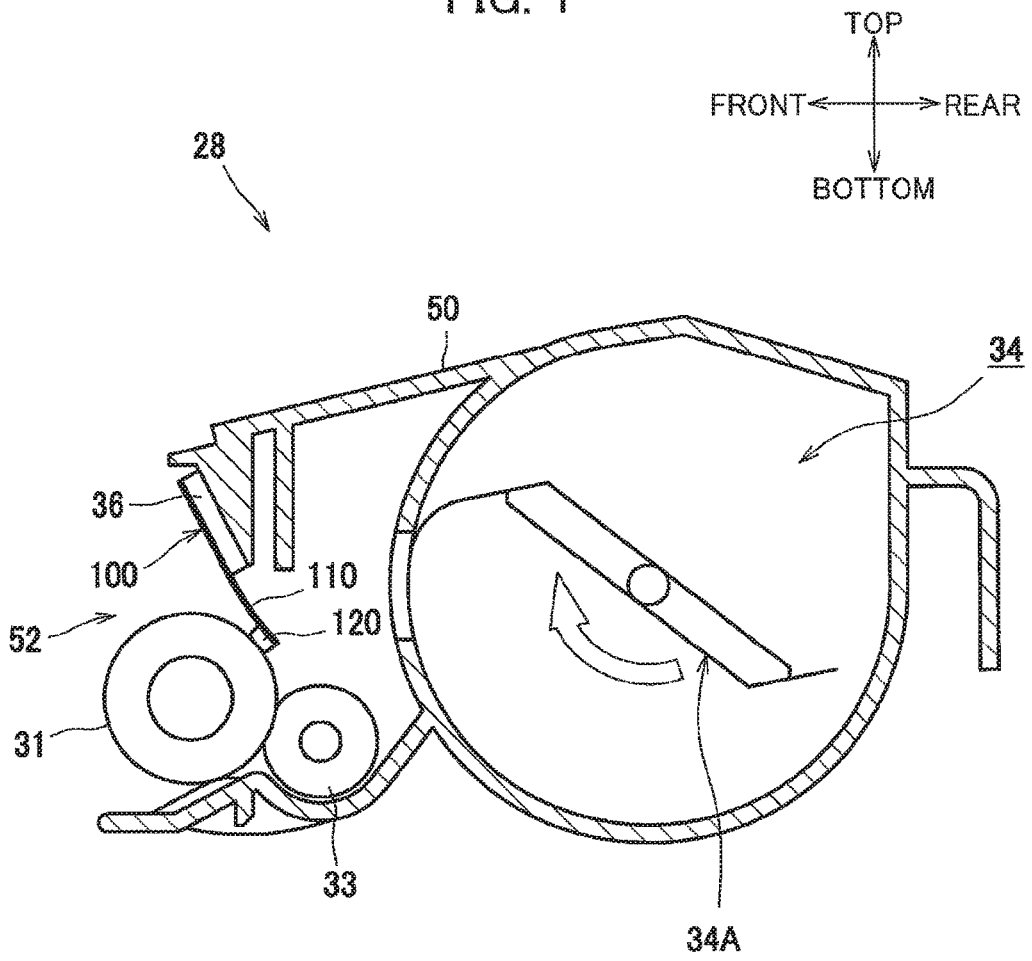
FIG. 1 is a schematic view of a developing device according to an embodiment of the present disclosure.

In the following description, the left side Of the device in FIG. 1 is defined as the "front side," the right side as the "rear side," the near side as the "left side," and the far side as the "right side." Further, a top side and bottom side are defined based on the upward and downward directions in FIG. 1.

FIG. 1 illustrates a developing device 28 according to the present embodiment that is used in a printer or other image-forming device. As shown in FIG. 1, the developing device 28 includes a developing roller 31, a thickness-regulating blade 100, a supply roller 33, and a toner-accommodating chamber 34.

In the developing device 28 of the embodiment, toner accommodated in the toner-accommodating chamber 34 is agitated by an agitator 34A and is supplied onto the developing roller 31 by the supply roller 33. At this time, the toner is positively tribocharged between the supply roller 33 and developing roller 31. The toner carried on the circumferential surface of the developing roller 31 subsequently passes between the thickness-regulating blade 100 and developing roller 31 as the developing roller 31 rotates. The thickness-regulating blade 100 regulates the layer of toner carried on the developing roller 31 at a uniform thickness while further tribocharging the toner. The toner employed in the present embodiment is a positive-chargeable, nonmagnetic, single-component toner. The toner is produced by mixing (1) a styrene-acrylic resin formed in spherical shapes by a method of suspension polymerization with (2) a well-known colorant, such as carbon black, and (3) a charge control agent, such as a quaternary ammonium salt. The toner base particles have an average particle size of 4-10 μm and are treated with silica as an external additive.

<Detailed Structure of the Developing Device>

Next, the structure of the developing device 28 will be described in greater detail.

The developing device 28 has a structure that is essentially symmetrical in the left-right except for a gear assembly functioning to transmit a drive force from a motor (not shown) provided in the body of the printer. For this reason, the accompanying drawings show regions of the left side of the developing device 28 and not the right side.

In addition to the developing roller 31 and other components described above, the developing device 28 includes a housing 50 that accommodates toner, a pair of side seals 200 that slidingly contact the circumferential surface of the developing roller 31 at the axial ends thereof, a lower seal 35, and a pair of lower side seals 37. The side seals 200 are examples of the first sealing members. The lower seal 35 is an example of the second sealing member. The lower side seals 37 are examples of the third sealing members.

Figure 2:
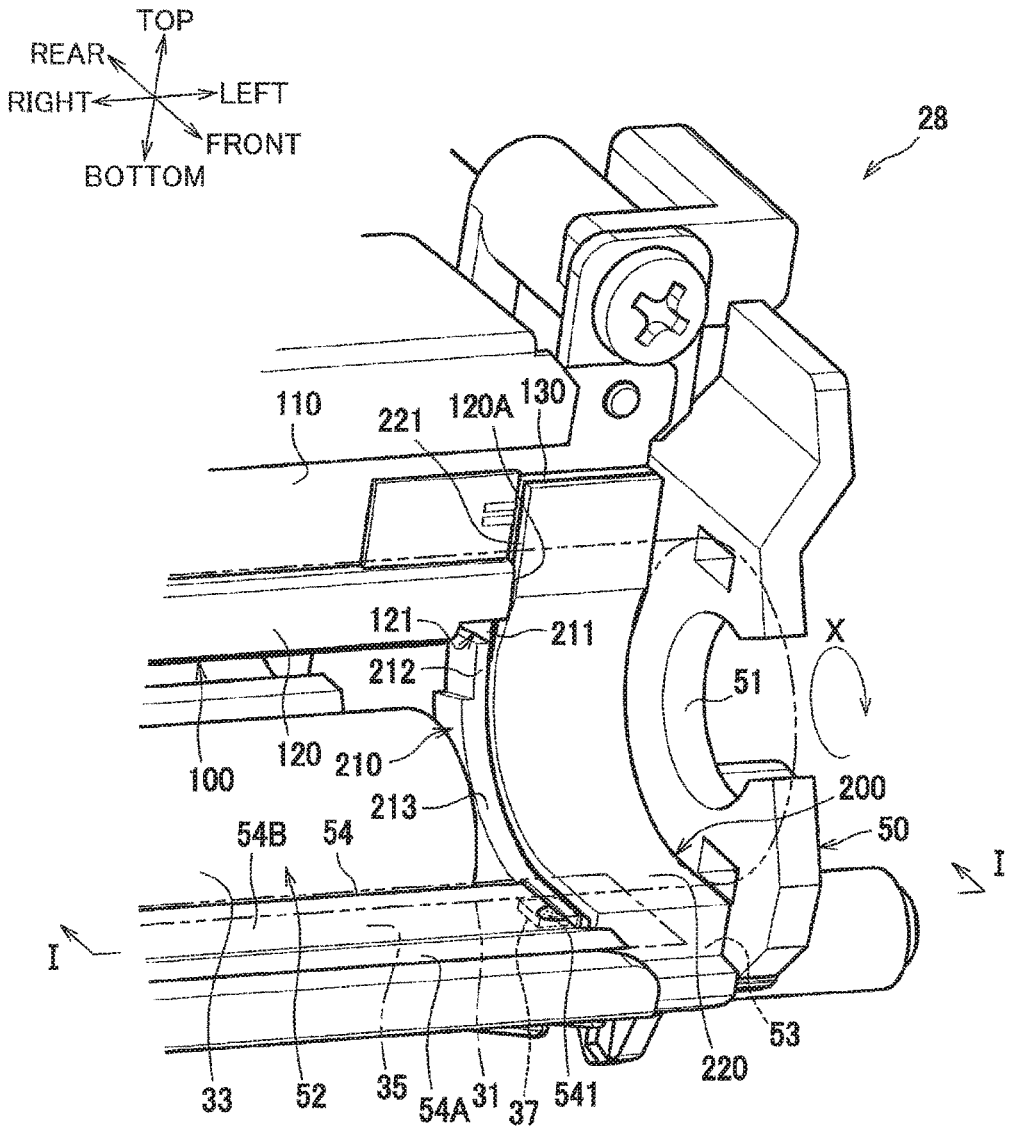
FIG. 2 is a perspective view illustrating a structure around a left side of the developing device.

As indicated by the arrow X in FIG. 2, the developing roller 31 of the present embodiment is rotated so that its circumferential surface slides against the surface of the side seals 200 in a direction from the bottoms of the side seals 200 toward the tops. In the following description, the rotating direction of the developing roller 31 will simply be referred to as the "rotating direction X."

The housing 50 is provided with bearing parts 51 formed in its sides for rotatably supporting the developing roller 31; an open area 52 formed in its lower-rear side in which toner is supplied from the toner-accommodating chamber 34 to the developing roller 31; side seal attachment surfaces 53, as examples of the sealing member mounting surfaces, to which the side seals 200 are affixed; and a support part 54 that supports the lower seal 35.

The open area 52 is a rectangular space elongated in the left-right direction, i.e., along the axis of the developing roller 31. The thickness-regulating blade 100 is fixed to the housing 50 above the open area 52.

The thickness-regulating blade 100 includes a plate-like blade 110 elongated in the left-right direction, and a rubber pressing part 120 affixed to the bottom edge (distal edge) of the plate-like blade 110.

As shown in FIG. 1, the thickness-regulating blade 100 is fixed to the housing 50 with a blade-back seal 36 interposed between the thickness-regulating blade 100 and housing 50. The blade-back seal 36 is elongated in the left-right direction so as to extend all the way to the left-right edges of the plate-like blade 110 (see FIG. 3A).

The pressing part 120 is a rubber member formed of silicone rubber or urethane rubber, for example. The pressing part 120 protrudes from the plate-like blade 110 and contacts the circumferential surface of the developing roller 31.

Figure 3A:
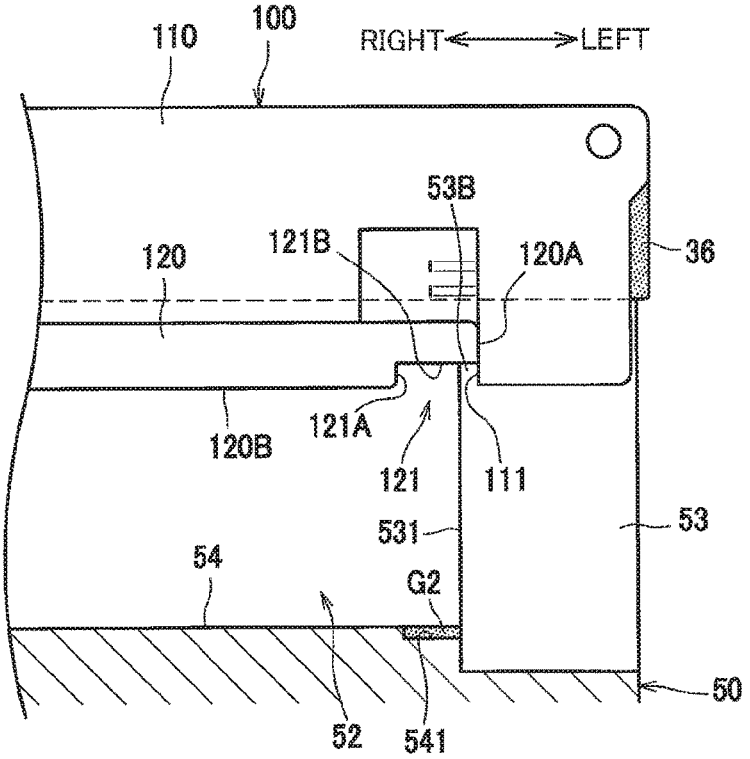
FIGS. 3A and 3B are each a cross-sectional view of an edge of a thickness-regulating blade and a housing in the developing device taken along a plane shown in FIG. 2.

As shown in FIG. 2, the pressing part 120 has a notched part 121 on each of its left and right ends. The notched parts 121 are recessed into the upstream. edges of the pressing part 120 in the rotating direction X and are recessed inward in the left-right direction from the end faces 120A of the pressing part 120. As shown in FIG. 3A, the pressing part 120 has a first surface 121A that extends upward in the rotating direction X from the bottom surface 120B, and a second surface 121B that extends outward in the left-right direction from the first surface 121A and connects to the corresponding end face 120A on the respective left-right side of the pressing part 120.

The section of the pressing part 120 in which the notched parts 121 are not formed (the section offset from the notched parts 121 in the left-right direction) has a general semicircular shape in cross section. The surface of the pressing part 120 in this section can contact the circumferential surface of the developing roller 31. The areas of the pressing part 120 in which the notched parts 121 are formed have a cross section in the general shape of a quarter circle and are capable of contacting the developing roller 31 with the sharp edge of this arc. Since the bottom portions of the pressing part 120 defining the notched parts 121 are more angular than the section of the pressing part 120 in which the notched parts 121 are not formed, these portions can more easily scrape toner off the circumferential surface of the developing roller 31.

The areas of the plate-like blade 110 corresponding to the notched parts 121 are shaped to conform to the notched parts 121. That is, the plate-like blade 110 has notches 111 formed in the areas confronting the notched parts 121 that have a similar shape to the same.

Figure 3B:
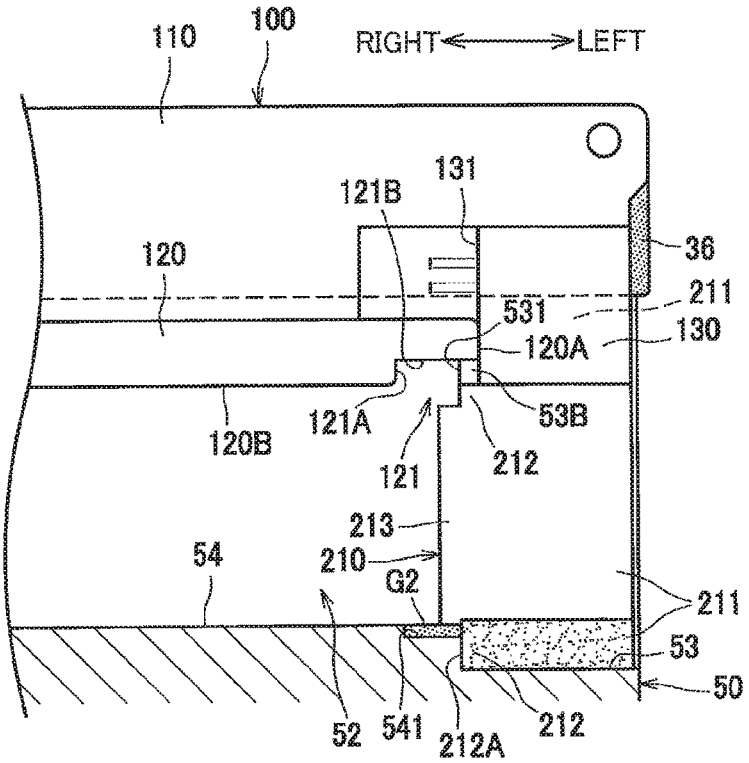

As shown in FIG. 3B, a pair of side edge seals 130 is formed in the left and right ends of the plate-like blade 110. The side edge seals 130 are sponge members, for example, and are fixed to the exposed surface (the surface opposing the developing roller 31) of the plate-like blade 110. The side edge seals 130 are provided in areas ranging from a position above the pressing part 120 to the distal edge of the plate-like blade 110. Each side edge seal 130 has an end face 131 on the left-right inner side that contacts the corresponding left-right end face 120A of the pressing part 120. The side edge seals 130 suppress toner leakage from the left and right ends of the pressing part 120.

As shown in FIG. 3A, the side seal attachment surfaces 53 are formed on side walls of the housing 50 provided on the left and right sides of the open area 52 and oppose the developing roller 31 and plate-like blade 110. As shown in FIG. 4B, the side seal attachment surfaces 53 have a general arc shape in cross section that conforms to the circumferential surface of the developing roller 31, and extend from a position beneath the developing roller 31 to a position overlapping the blade-back seal 36 on the back side of the plate-like blade 110. As shown in FIG. 3A, a left-right inner edge 531 of each side seal attachment surface 53 extends along the rotating direction X at a position farther outward in the left-right direction from the left-right center of the corresponding notched part 121.

The support part 54 is arranged inside the side seal attachment surfaces 53 with respect to the left-right direction. The support part 54 protrudes upward, i.e., toward the developing roller 31, more than the side seal attachment surface 53 and extends along the axial direction of the developing roller 31. The top surface of the support part 54 is configured of a film attachment surface 54A disposed along the front edge of the housing 50, and an extended surface 54B arranged on the rear side of the film attachment surface 54A. The extended surface 54B is set lower in position than the film attachment surface 54A. Grooves 541 are formed in the left and right ends of the extended surface 54B. Each groove 541 is recessed inward in the left-right direction into the extended surface 54B from the end face on the corresponding side seal attachment surface 53 side. A lubricant G2, such as grease, is provided inside the grooves 541.

Lubricants G and G2 described in the present embodiment may be formed of a fluorine-based resin and fluorinated oil dispersed in a solvent. Specifically, the lubricant used in the embodiment may contain 80-90 wt % perfluoroalkane as the solvent, and 10-20 wt % polytetrafluoroethylene as the fluorine-based resin and fluorinated oil.

As shown in FIG. 2, the lower side seals 37 are provided on the extended surface 54B, and the lower seal 35 is provided on the film attachment surface 54A.

The lower side seals 37 are configured of a sponge or other elastic member and are fixed to the corresponding left-right edges of the extended surface 54B so as to make close contact with the stepped surface of the film attachment surface 54A adjacent to the extended surface 54B and the inner left-right end faces of the corresponding side seals 200. The lower side seals 37 suppress toner from leaking out through gaps between the side seals 200 and the support part 54.

The lower seal 35 is a film-like member formed of a resin such as polyethylene terephthalate. The lower seal 35 extends along the entire axial length of the developing roller 31 so as to slidingly contact substantially the entire developing roller 31. The lower seal 35 is formed longer in the left-right direction than the support part 54. The lower seal 35 is fixed to the film attachment surface 54A such that its left-right ends overlap the lower side seals 37 and extend beyond the left-right ends of the support part 54 to overlap the left-right side seals 200. This arrangement can suppress toner leakage between the side seals 200 and the lower seal 35.

<Side Seals>

The side seals 200 are provided between the circumferential surface of the developing roller 31 at respective left and right ends thereof and the corresponding side seal attachment surfaces 53. The side seals 200 suppress the leakage of toner between the ends of the developing roller 31 disposed in the open area 52 of the housing 50 and the corresponding side seal attachment surfaces 53. Each side seal 200 is configured of a base layer 210, and a surface layer 220.

The base layer 210 is an elastic body, such as an elastically deformable urethane sponge. The base layer 210 is an example of the second layer. As shown in FIG. 3B, the base layer 210 is fixed to the corresponding side seal attachment surface 53 of the housing 50 with double-sided tape or the like.

The base layer 210 includes a main portion 211 positioned outside the pressing part 120 relative to the left-right direction, a first protruding part 212 as an example of the protruding part of the disclosure that protrudes inward in the left-right direction from the main portion 211, and a second protruding part 213 that protrudes further inward in the left-right direction from the first protruding part 212.

Figure 4A:
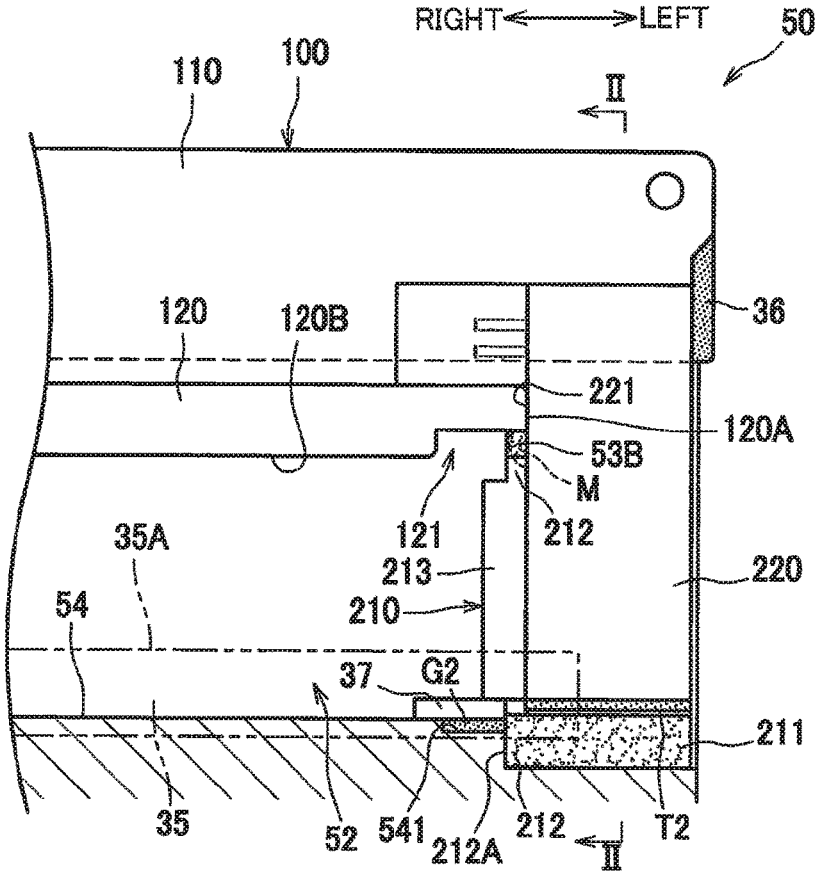
FIGS. 4A and 4B are each a cross-sectional view of the developing device.
Figure 4B:
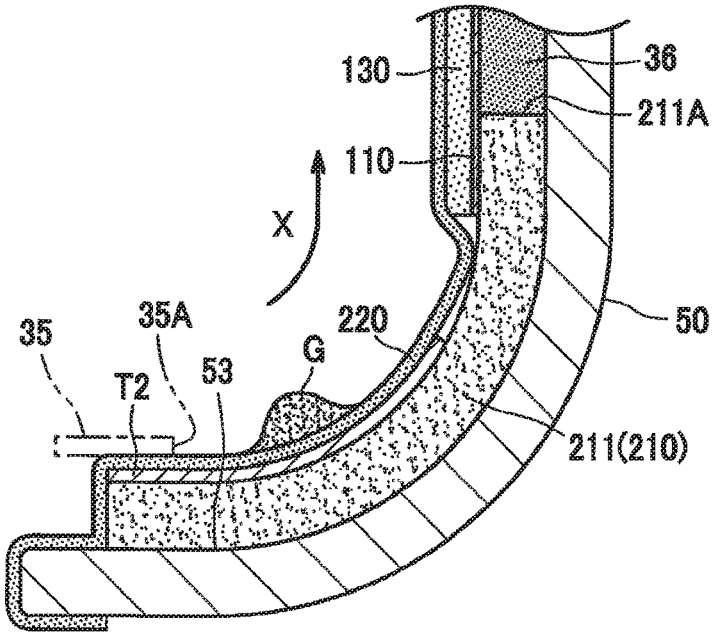

As shown in FIGS. 4A and 4B, the main portion 211 extends from a position between the plate-like blade 110 and the housing 50 to a position upstream in the rotating direction X from an edge 35A on the downstream side of the lower seal 35 in the rotating direction X. An end face 211A of the main portion 211 on the downstream side in the rotating direction X is in contact with the blade-back seal 36.

As shown in FIG. 3B, the first protruding part 212 is separated from the pressing part 120 toward the upstream side in the rotating direction X and protrudes inward in the left-right direction from the main portion 211 to a position farther inward than the corresponding end face 120A of the pressing part 120. More specifically, the downstream edge of the first protruding part 212 with respect to the rotating direction X is substantially flush with the bottom surface 120B of the pressing part 120 with respect to the rotating direction X. The first protruding part 212 is positioned to the inside of the corresponding surface layer 220 in the left-right direction. The gap between the first protruding part 212 and the corresponding second surface 121B defining the downstream side of the notched part 121 in the rotating direction X is at least 1.5 mm and no greater than 3.5 mm, for example. The upstream end of the first protruding part 212 in the rotating direction X extends along the rotating direction X to a position on the outer left-right side of the support part 54. A left-right inner end face 212A on the upstream end of the first protruding part 212 is in contact with the support part 54. Consequently, the corresponding left-right end of the lower seal 35 overlaps the top of the first protruding part 212, as illustrated in FIG. 4A. The corresponding lower side seal 37 is in contact with the left-right inner end face 212A on the upstream end of the first protruding part 212 with respect to the rotating direction X. In the present embodiment, the lower side seal 37 is also in contact with the left-right inner end face of the surface layer 220.

As shown in FIG. 3B, the second protruding part 213 protrudes further inward in the left-right direction from the corresponding first protruding part 212 at a position upstream in the rotating direction X from the downstream end of the first protruding part 212 with respect to the rotating direction X.

Of this base layer 210, both the main portion 211 and first protruding part 212 are mounted on the corresponding side seal attachment surface 53, while the second protruding part 213 projects inward in the left-right direction from the corresponding side seal attachment surface 53. With the arrangement of the base layer 210 described above, a wall part 53B constituting part of the housing 50 protrudes between the blade-back seal 36 and first protruding part 212 to a position on the left-right inner side of the main portion 211. A portion of the wall part 53B is disposed between the second surface 121B of the pressing part 120 and the first protruding part 212 in the rotating direction X and confronts the circumferential surface of the developing roller 31. Note that there are no components, other than toner or lubricant, provided between the developing roller 31 and the portion of the wall part 53B confronting the developing roller 31. In the present embodiment, the side seal attachment surface 53 is formed flush with the surface of the wall part 53B confronting the developing roller 31.

The main portion 211 of the base layer 210 is arranged outside of the wall part 53B in the left-right direction. The first protruding part 212 of the base layer 210 is arranged upstream of the wall part 53B in the rotating direction X.

Figure 5:
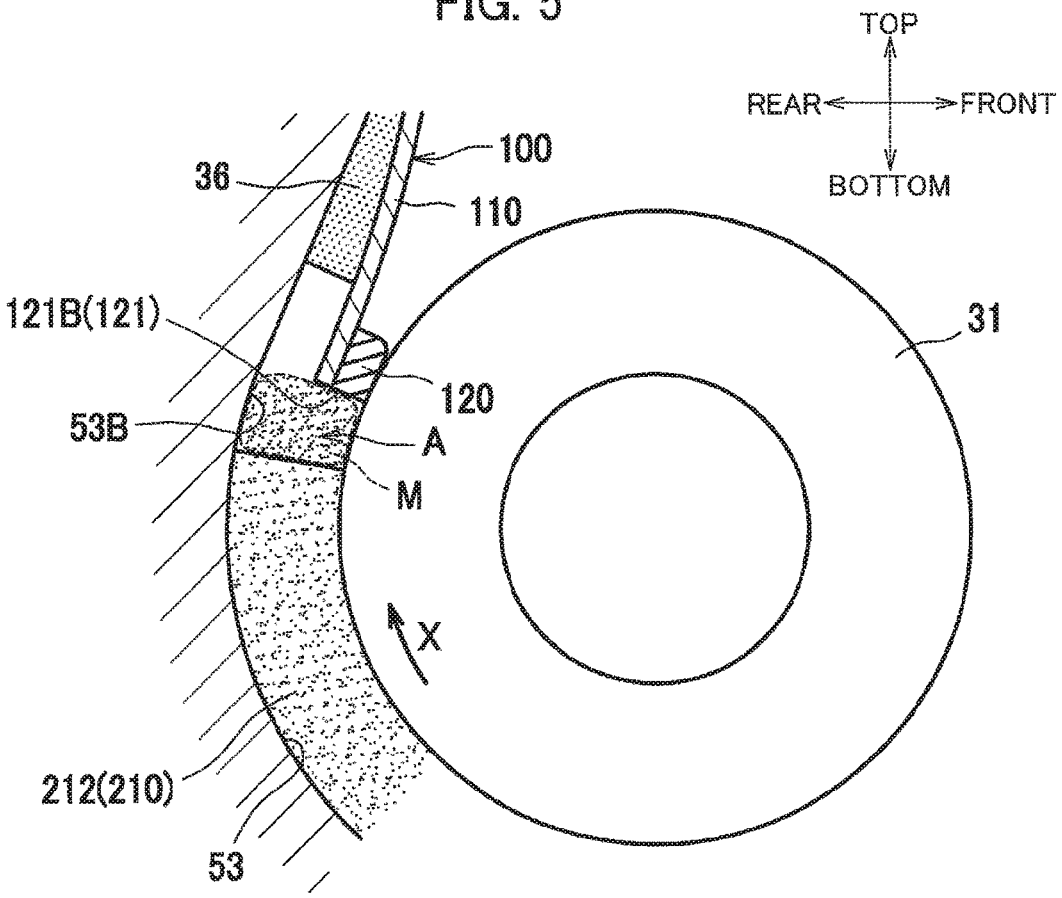
FIG. 5 is a cross-sectional view of the developing device taken along a plane perpendicular to a right-left direction and passing through a notched part.

As shown in FIG. 5, the wall part 53B extends to the bottom edge of the blade-back seal 36, which is downstream of the notched part 121 formed in the pressing part 120 with respect to the rotating direction X, and specifically downstream in the rotating direction X from the upstream edge of the plate-like blade 110 (i.e., the portion of the plate-like blade 110 flush with the second surface 121B). In other words, across its entire left-right dimension, the blade-back seal 36 extends to the downstream side of the wall part 53B with respect to the rotating direction X. The portion of the wall part 53B positioned on the back side of the plate-like blade 110 is separated from the same.

As shown in FIG. 3B, part of the wall part 53B is positioned inside the notched part 121 with respect to the rotating direction X. The inner left-right edge of the wail part 53B (i.e., the inner edge 531 of the side seal attachment surface 53) is positioned to the outer left-right side of the first surface 121A defining the inner left-right edge of the notched part 121. The left-right dimension of the notched part 121 is set to at least twice the left-right dimension of the wall part 53B. For example, the left-right dimension of the notched part 121 is set to at least 3.0 mm and no greater than 5.0 mm, while the left-right dimension of the wall part 53B is set to at least 0.5 mm and no greater than 2.5 mm.

The surface layer 220 is an example of the first layer in the disclosure. As shown in FIG. 2, the surface layer 220 is arranged to contact the circumferential surface of the developing roller 31. The surface layer 220 is laminated over and supported on the surface of the base layer 210 on the developing roller 31 side. The surface layer 220 has a rectangular shape with substantially the same left-right width as the main portion 211 of the base layer 210. As shown in FIGS. 4A and 4B, the surface layer 220 is fixed to the top of the main portion 211 by double-sided tape T2. The surface layer 220 extends from a position overlapping the side edge seal 130 to a position further frontward than the bottom end of the base layer 210. The top edge of the surface layer 220 is positioned higher than the top edge of the pressing part 120. The left-right inner end face 221 of the surface layer 220 contacts the corresponding left-right end face 120A constituting the pressing part 120.

A lubricant G is applied to a portion of the surface layer 220 during manufacturing. After manufacturing of the developing device 28 is complete, the developing roller 31 is rotated to spread the lubricant G over the entire surface of the side seal 200. Specifically, the lubricant G spreads over the entire surface layer 220 as the developing roller 31 rotates, migrating inward in the left-right direction over the textures of the surface layer 220 and spreading all the way to the first protruding part 212 and second protruding part 213. The lubricant G is further supplied into a space A defined by the pressing part 120, surface layer 220, first protruding part 212, and wall part 53B. Note that it is also possible to apply the lubricant G over the entire surface of the side seal 200, i.e., over the entire surface of the surface layer 220 and the entire surfaces of the first protruding part 212 and second protruding part 213, during the manufacturing stage.

Figure 6A:
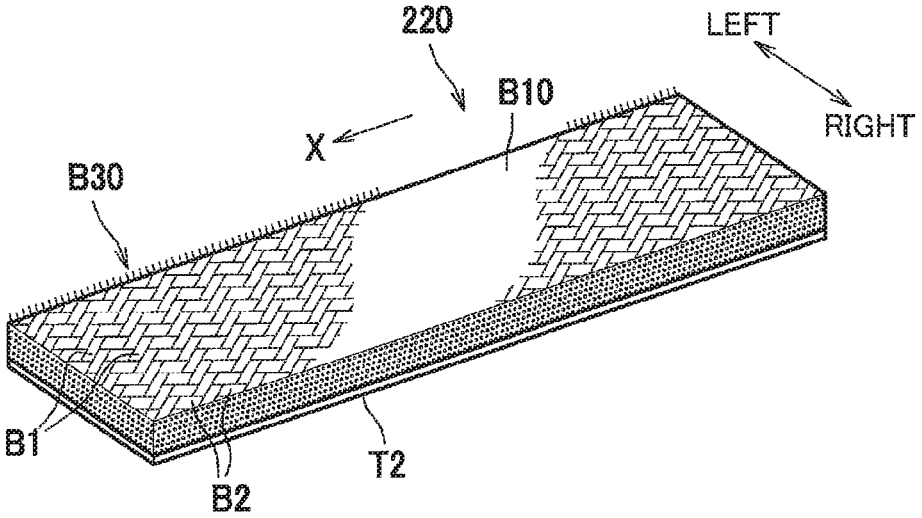
FIGS. 6A and 6B each illustrates a surface layer of the developing device.
Figure 6B:
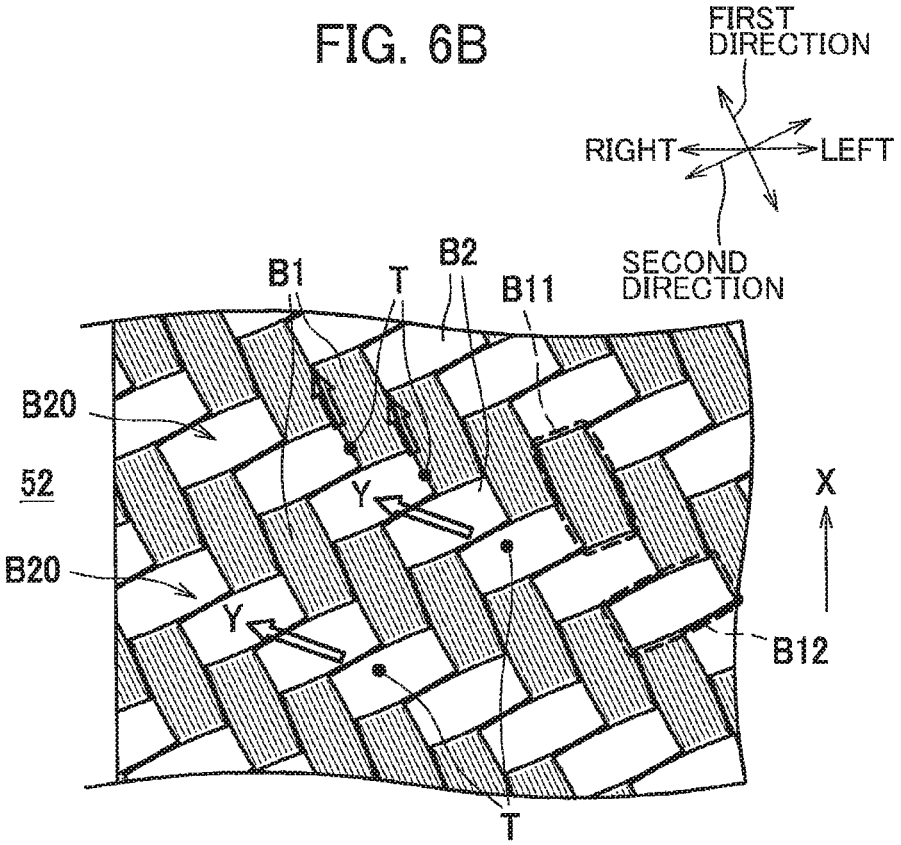

As shown in FIGS. 6A and 6B, the surface layer 220 is a woven fabric member formed by weaving a plurality of warp threads B1 across a plurality of weft threads B2. The warp threads B1 extend in a first direction that is sloped relative to the left-right direction, while the weft threads B2 extend in a second direction that is also sloped relative to the left-right direction.

The first direction in the embodiment denotes a direction from left to right (i.e., from the outer left-right side to the inner left-right side of the left side seal 200) while progressing downstream in the rotating direction X of the developing roller 31. The second direction in the embodiment denotes a direction from right to left, i.e., from the inner left-right side to the outer left-right side of the side seal 200 while progressing downstream in the rotating direction X.

Further, the warp threads B1 denote threads constituting the surface layer 220 that form a smaller angle with the rotating direction X of the developing roller 31, while the weft threads B2 denote threads constituting the surface layer 220 that form a larger angle with the rotating direction X. The warp threads B1 and weft threads B2 are woven across each other at an angle of approximately 90 degrees.

The warp threads B1 in the surface layer 220 have a diameter of approximately 150 μm, while the weft threads B2 have a diameter of approximately 200 μm. The threads are preferably interwoven using a twill or satin weave. The surface layer 220 used in the present embodiment is formed with a twill weave in which the warp threads B1 are alternately passed over two adjacent weft threads B2 and under the next two adjacent weft threads B2.

The warp threads B1 are arranged with a plurality adjacent to each other in the second direction of the surface layer 220 (the direction in which the weft threads B2 extend) and a plurality arranged in the thickness direction of the surface layer 220. Similarly, the weft threads B2 are arranged with a plurality adjacent to each other in the first direction of the surface layer 220 (the direction in which the warp threads B1 extend) and a plurality arranged in the thickness direction of the surface layer 220. For convenience and simplicity of the drawings, the warp threads B1 and weft threads B2 have been omitted from FIG. 3 and the like.

The surface layer 220 has been woven such that portions of the warp threads B1 passing over weft threads B2 (hereinafter called first portions B11) protrude farther toward the developing roller 31 side than the portions of warp threads B1 passing under the weft threads B2 (hereinafter called second portions B12) in its surface B10 opposing the developing roller 31. The first portions B11 are the parts of warp threads B1 that the developing roller 31 slidingly contacts when rotated. Hence, among the warp threads 131 and weft threads B2, the warp threads B1 correspond to the threads that slidingly contact the developing roller 31.

Further, a plurality of first portions B11 adjacent to each other in the second direction is juxtaposed in a diagonal direction that slopes downstream in the rotating direction X from the left side (the outer left-right side) toward the right side (the inner left-right side). Similarly, a plurality of second portions B12 adjacent to each other in the first direction is juxtaposed along a diagonal direction that slopes downstream in the rotating direction X from the left side toward the right side. Thus, groove sections B20 that are recessed away from the developing roller 31 are defined by the top surfaces of second portions B12 and the side surfaces of each pair of first portions B11 that oppose each other across the second portions B12.

The groove sections B20 extend along the direction that the second portions B12 are arranged, i.e., the direction indicated by the arrows Y in FIG. 6B that slope left to right (i.e., from the outer left-right side toward the inner left-right side) while moving from the upstream side to the downstream side of the rotating direction X.

Further, the warp threads B1 and weft threads B2 have circumferential surfaces whose heat release per unit area is a first release, and end faces whose heat release per unit area is a second heat release greater than the first heat release. Some specific fibers that can be employed as warp threads B1 and weft threads B2 with these properties are fibers with a linear molecular structure, such as ultra-high-molecular-weight (high-modulus) polyethylene and polyparaphenylene benzobisoxazole (PBO) fibers. Further, when subjected to a temperature of 100K, the fibers preferably have a heat conductivity of at least 0.1 W/cm·K and no greater than 1.0 W/cm·K in directions toward the end faces, and a heat conductivity of at least 2-50 times that value in the circumferential direction. The fibers used in the present embodiment were Dyneema® (Dyneema is a registered trademark) SK60 manufactured by Toyobo Co., Ltd.

Next, the operational advantages of the developing device 28 having the above construction will be described.

The developing roller 31 rotates while in contact with the side seals 200, pressing part 120, and side edge seals 130.

As illustrated in FIGS. 4A and 5, toner and lubricant G enter the spaces A defined by the developing roller 31, pressing part 120, surface layers 220, main portions 211, first protruding parts 212, and wall parts 53B at this time. The toner mixes with the lubricant G to form a mixture M of toner and lubricant G. The mixture M of toner and lubricant G form a wall capable of restraining toner that has been scraped off the developing roller 31 by the pressing part 120 from moving swiftly toward the side seals 200, thereby suppressing toner from leaking out of the developing device 28.

A particular feature of the embodiment is the notched parts 121 formed in the left and right ends of the pressing part 120. The edges of the pressing part 120 defining the notched parts 121 scrape a larger amount of toner from the developing roller 31 than other parts of the pressing part 120. This construction is effective, as the large amount of toner scraped by the edges defining the notched parts 121 flows rapidly toward the corresponding side seals 200 along the second surfaces 121B of the notched parts 121.

Further, since the wall parts 53B are provided within the notched parts 121 in the rotating direction X, the spaces A can be provided closer to the notched parts 121 through which the toner rapidly flows than in an arrangement in which the wall parts 53B are provided outside of the notched parts 121.

Thus, by forming the plate-like blade 110 such that its areas corresponding to the notched parts 121 are shaped to conform to the notched parts 121, the spaces A can be formed between the respective wall parts 53B and the developing roller 31.

As illustrated in FIG. 5, toner continues to flow into the spaces A as the developing roller 31 rotates. However, the wall parts 53B extend further downstream in the rotating direction X than the upstream edge of the plate-like blade 110 and are separated from the plate-like blade 110. Hence, toner and the mixture M of toner and lubricant G flowing into the spaces A follow the wall parts 53B to the back side of the plate-like blade 110, thereby suppressing an excessive amount of toner from accumulating in the spaces A. Further, the space on the back side of the plate-like blade 110 can be filled in with the mixture M of toner and lubricant G migrating behind the plate-like blade 110.

Since the left and right ends of the blade-back seal 36 are disposed downstream of the wall parts 53B in the rotating direction X, the blade-back seal 36 can block off the mixture M of toner and lubricant G flowing behind the plate-like blade 110 along the wall parts 53B.

Further, since the end faces 211A on the downstream ends of the main portions 211 with respect to the rotating direction X are in contact with the blade-back seal 36, toner entering the area behind the plate-like blade 110 along the wall parts 53B can be restrained from leaking out of the developing device 28.

Further, the lower seal 35 is arranged to overlap the first protruding parts 212 of the base layers 210, as illustrated in FIG. 4A. Accordingly, this arrangement can suppress toner from leaking between the side seals 200 and the lower seal 35.

The lower side seals 37 are in contact with the left-right inner end faces 212A of the first protruding parts 212 at the upstream ends of the side seals 200 in the rotating direction X. Accordingly, toner can be restrained from leaking out of the developing device 28 along the left-right inner end faces 212A of the first protruding parts 212.

By providing the lubricant G2 in the grooves 541 of the support part 54, the lubricant G2 enters the gaps formed between the support part 54 and the first protruding parts 212. In this way, the lubricant G2 can restrain toner from leaking out of the developing device 28 through the gaps between the support part 54 and first protruding parts 212.

As illustrated in FIG. 6B, the axial ends of the developing roller 31 slide against the surface B10 of the side seal 200 that confronts the developing roller 31 as the developing roller 31 rotates. At this time, toner particles T adhere to the surfaces of the side seals 200.

The toner particles T adhering to the surfaces of the side seals 200 migrate along the warp threads B1 of the surface layers 220 as the developing roller 31 rotates and enter the groove sections B20. The toner particles T then migrate in the direction of the arrow Y from the upstream side to the downstream side of the rotating direction X, i.e., toward the downstream ends of the groove sections B20 (in other words, inward in the left-right direction) and are discharged from the inner left-right ends of the groove sections B20 into the open area 52. This configuration can suppress toner from leaking out of the developing device 28. Further, the lubricant C and toner particles T are more easily supplied into the spaces A.

While the description has been made in detail with reference to specific embodiments thereof, it would he apparent to those skilled in the art that many modifications and variations may be made therein without departing from the spirit of the above described embodiment and the scope of which is defined by the attached claims.

In the embodiment described above, the surfaces of the wall parts 53B facing the developing roller 31 are formed flush with the side seal attachment surfaces 53, but the wall parts are not limited to this configuration. For example, the wall parts may be formed as surfaces set back relative to the side seal attachment surfaces 53 or may be surfaces projecting farther outward than the side seal attachment surfaces 53. Further, the wall parts may be provided separately from the side walls of the housing 50 on which the side seal attachment surfaces 53 are provided and may be slightly separated from the side seal attachment surfaces 53.

In the embodiment, the surface layer 220 is given as an example of the first layer surface in the disclosure, but the structure of the sealing members is not limited to the present embodiment. For example, the surfaces of the sealing members may be formed of a fiber member other than woven fabric, such as nonwoven fabric, or may be a member other than a fiber member.

Further, the sealing members need not be divided into abuse layer and a surface layer, but may be configured of a single elastic member instead.

While the notched parts 121 are formed in the pressing part 120 in the present embodiment, the pressing part 120 need not be provided with notched parts.

While the side seals 200 are fixed to the housing 50 with double-sided tape in the embodiment described above, the method of fixing the side seals 200 is not limited to the embodiment. For example, the side seals 200 may be fixed to the housing 50 by interposing the side seals 200 between ribs or the like protruding from the housing 50.

The developing device of the disclosure may employ any fluorine-based lubricant as the lubricants G and G2, such as silicone grease or heat-resistant fluorinated grease.

What is claimed is:

1. A developing device comprising:

a housing;

a developing roller rotatable in a rotating direction, the developing roller extending in an axial direction and having a circumferential surface and an axial end portion;

a thickness-regulating blade comprising:

a blade having a distal end portion; and a pressing part elongated in the axial direction and protruding from the distal end portion to contact the circumferential surface of the developing roller;

a first sealing member provided between the housing and the axial end portion, the first sealing member comprising:

a first layer having a first layer surface disposed to contact the circumferential surface of the developing roller; and a second layer supporting the first layer, the second layer having a protruding part protruding inward of the first layer in the axial direction, the protruding part having a second layer surface opposing the circumferential surface of the developing roller, the housing having a wall part disposed between the pressing part and the protruding part in the rotating direction, the wall part having an opposing surface opposing the circumferential surface of the developing roller; and a lubricant applied to the first layer surface and the second layer surface.

2. The developing device according to claim 1, wherein the pressing part has an upstream end in the rotating direction and has an axial end portion, the pressing part being formed with a notched part recessed from the upstream end in the rotating direction at the axial end portion of the pressing part, the wall part having a part disposed between the notched part and the protruding part in the rotating direction.

3. The developing device according to claim 2, wherein the blade has an area corresponding to the notched part, the area having a shape in conformance with a shape of the notched part.

4. The developing device according to claim 2, wherein the wall part has an inward edge in the axial direction, the notched part having a first surface defining an inner edge of the notched part in the axial direction, and the inward edge being positioned outward of the first surface in the axial direction.

5. The developing device according to claim 4, wherein a length of the notched part in the axial direction is at least twice as large as a length of the wall part in the axial direction.

6. The developing device according to claim 4, wherein a length of the wall part in the axial direction is in a range of 0.5 mm to 2.5 mm.

7. The developing device according to claim 4, wherein a length of the notched part in the axial direction is in a range of 3.0 mm to 5.0 mm.

8. The developing device according to claim 2, wherein the notched part has a second surface defining a downstream end of the notched part in the rotating direction, a distance between the second surface and the protruding part being in a range of 1.5 mm to 3.5 mm.

9. The developing device according to claim 2, wherein the wall part extends to a downstream side of the notched part in the rotating direction.

10. The developing device according to claim 2, wherein the notched part is shaped by:

a first surface extending in the rotating direction and defining an inner edge of the notched part in the axial direction, the first surface having a downstream end in the rotating direction; and a second surface extending in the axial direction from the downstream end of the first surface and defining a downstream edge of the notched part in the rotating direction.

11. The developing device according to claim 1, wherein the second layer is positioned outward of the wall part in the axial direction.

12. The developing device according to claim 1, further comprising:

a seal interposed between the blade and the wall part, the seal extending in the axial direction at least to a downstream side of the wall part in the rotating direction.

13. The developing device according to claim 12, wherein the second layer has an end face defining a downstream end of the second layer in the rotating direction, the end face contacting the seal.

14. The developing device according to claim 1, wherein the blade has an upstream edge in the rotating direction, the wall part extending to a downstream side of the upstream edge of the blade in the rotating direction and being separated from the blade.

15. The developing device according to claim 1, further comprising:

a second sealing member provided on the housing and elongated in the axial direction, the second sealing member contacting the circumferential surface of the developing roller and having an axial end in the axial direction, the axial end overlapping the protruding part.

16. The developing device according to claim 15, further comprising:

a third sealing member provided on the housing, wherein the protruding part has an upstream end portion in the rotating direction, the upstream end portion having an end face defining an inside edge in the axial direction of the upstream end portion, the third sealing member contacting the end face.

17. The developing device according to claim 1, wherein the housing has a sealing member mounting surface, the first sealing member being provided on the sealing member mounting surface; and wherein the sealing member mounting surface is flush with the opposing surface of the wall part.

18. The developing device according to claim 1, wherein the pressing part has an end face defining an outer edge of the pressing part in the axial direction, the first layer contacting the end face of the pressing part; and wherein the protruding part is positioned inward of the end face of the pressing part in the axial direction.

* * * * *